United States Patent [19]

Ingold et al.

[11] Patent Number: 4,497,436

[45] Date of Patent: Feb. 5, 1985

[54] VENTING SYSTEM FOR INSULATING WINDOW SHADE

[75] Inventors: Daniel L. Ingold, Newfane; Robert L. Stewart, Brookfield, both of Vt.

[73] Assignee: Appropriate Technology Corporation, Brattleboro, Vt.

[21] Appl. No.: 467,390

[22] Filed: Feb. 17, 1983

[51] Int. Cl.[3] ..... F24J 3/02; F24F 13/10

[52] U.S. Cl. ..... 236/49; 126/418

[58] Field of Search ..... 236/49; 126/422, 418, 126/429; 160/120; 98/95, 98

[56] References Cited

U.S. PATENT DOCUMENTS

| | | | |
|---|---|---|---|
| 2,216,873 | 10/1940 | Browne | 236/49 X |
| 2,552,735 | 5/1951 | Rawson | 236/49 |
| 2,599,823 | 6/1952 | Gillen | 236/49 X |
| 3,990,635 | 11/1976 | Restle et al. | 236/49 X |
| 4,150,659 | 4/1979 | Buckley | 126/422 |
| 4,304,220 | 12/1981 | Brockhaus | 236/49 X |
| 4,309,983 | 1/1982 | Brill | 126/422 |
| 4,396,004 | 8/1983 | Koenig | 126/422 X |

*Primary Examiner*—William E. Tapolcai

*Attorney, Agent, or Firm*—Wolf, Greenfield & Sacks

[57] ABSTRACT

An insulating window shade assembly having a roll up shade which covers the window, seals about the shade to increase the effectiveness of the insulation provided by it, and venting means at the top and bottom of the shade assembly for allowing air to flow through the space between the shade and window to cool the space when the temperature exceeds a prescribed value.

9 Claims, 10 Drawing Figures

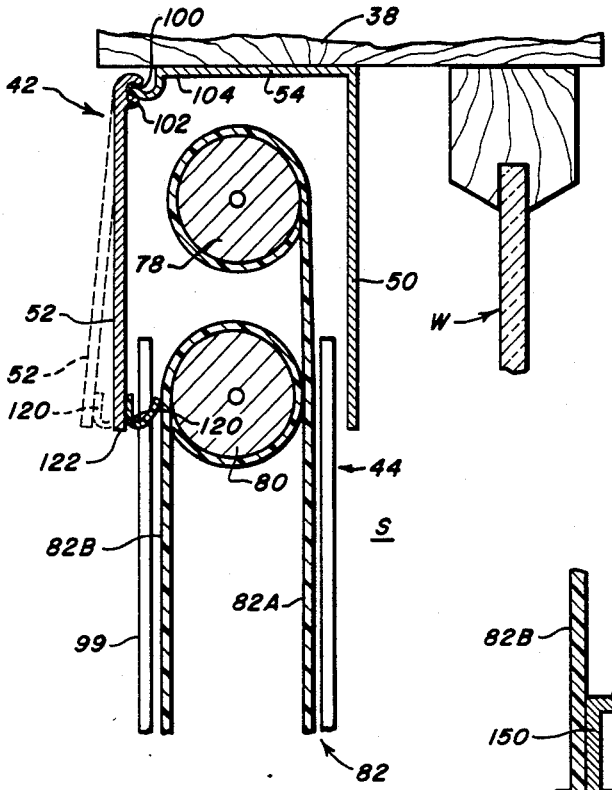
FIG. 3
FIG. 4
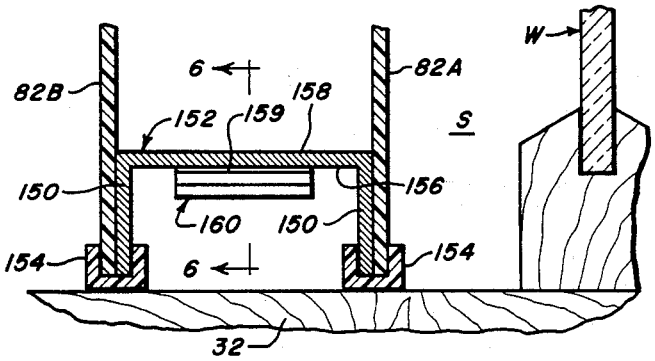
FIG. 5
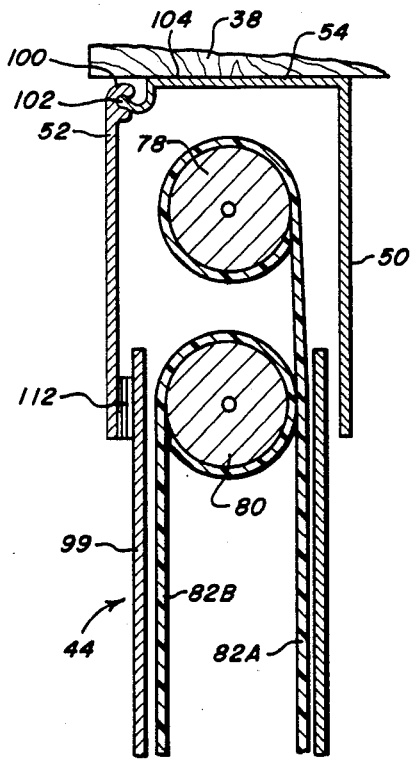
FIG. 5A
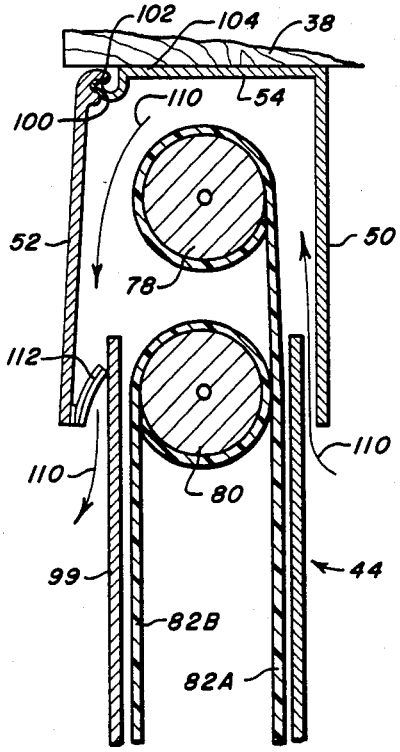

VENTING SYSTEM FOR INSULATING WINDOW SHADE

INTRODUCTION

This invention relates to insulating window shades and more particularly comprises an improved insulating window shade having a venting arrangement to relieve high temperatures that may be generated between the shade and the window during daylight hours.

Recent news articles have reported windows breaking because of insulating shades drawn over them in daytime hours. Experiments have demonstrated that well-sealed insulating shades when drawn over windows in daytime hours tend to act as solar collectors, and temperatures in the space between the insulating shade and window can reach the 200° F. range. Temperatures in that range can be harmful both to the window and the shade assembly. Statements from window manufacturers have suggested a loss of window warranty if insulating shades are used.

If the insulating shades are to be used with maximum effectiveness, some venting system must be provided to avoid the adverse effect of the extreme temperatures. The present invention provides venting systems for insulating shade assemblies which respond to elevated temperatures in the space between the shade and window and/or to the pressure differentials of the air in the space and in the room insulated by the shade.

In accordance with some embodiments of this invention, temperature sensitive elements control valve-like arrangements at the top and bottom of the shade and respond to elevated temperatures in the space between the shade and window. In accordance with other embodiments of this invention, one-way flapper-type valves are provided at the top and bottom and respond to pressure differentials for establishing natural convective air flow through the space.

This invention will be better understood and appreciated from the following detailed description read in connection with the accompanying drawings.

BRIEF FIGURE DESCRIPTION

FIG. 1 is a perspective view of a window seen from the inside on which an insulating window shade assembly embodying the present invention is installed;

FIGS. 2 and 3 are fragmentary cross-sectional views of the insulating window shade assembly, respectively taken on the section lines 2—2 and 3—3 in FIG. 1 and showing the seals at the sides and top of the shade assembly;

FIG. 4 is a fragmentary cross-sectional view of the shade assembly taken along section line 4—4 in FIG. 1, but showing the shade drawn so that its bottom engages the window sill to form a seal;

FIG. 5 is a fragmentary cross-sectional view through the valance of the shade assembly, taken on section line 5—5 in FIG. 1, and showing the means for venting the top of the assembly but in its closed position;

FIG. 5A is similar to FIG. 5 but showing the vent in its open position;

DETAILED DESCRIPTION

The venting system of this invention may be embodied in a great variety of insulating shade assemblies and it is not dependent upon the number of shade panels in the system, the materials from which the panels are made, and the particular configuration of the means for raising and lowering the shades and sealing the edges of the shade to the frame. Rather, the invention is applicable to all insulating window shades which form a closed, substantially sealed space on the inside of the window which it insulates, and which space acts as a solar collector during the daytime hours. In the following description the invention is shown embodied in an insulating shade assembly very similar to the shade assembly which forms the subject matter of copending application Ser. No. 06/406,064 filed Aug. 6, 1982 entitled "Edge Seal and Rerailer for Insulating Shade" and assigned to the assignee of this application. It is to be understood, however, that the breadth of the invention is not specifically limited to a shade of that construction.

Figure 1:
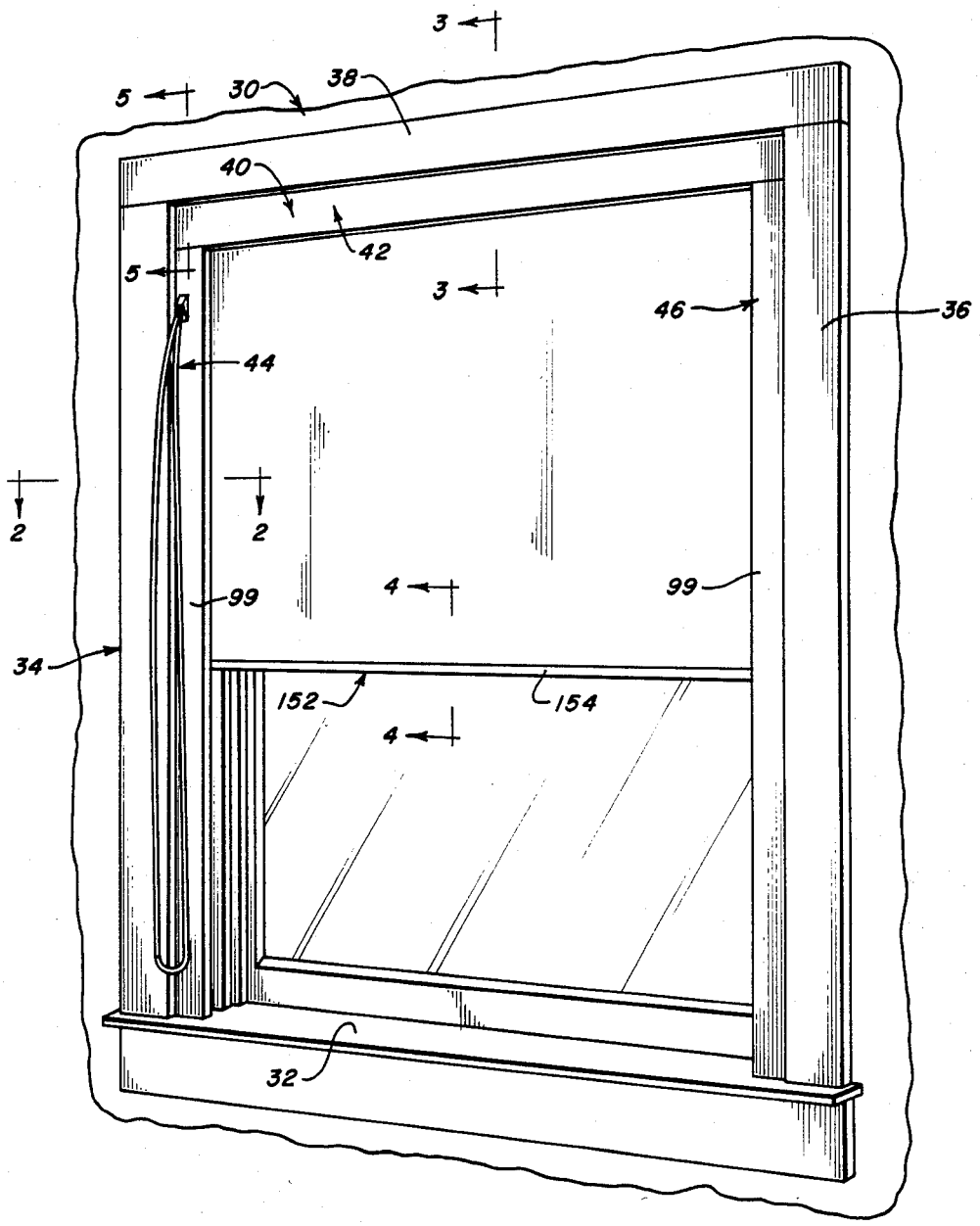

The insulating shade assembly of the present invention is shown in FIG. 1 installed within a window frame 30 that includes a sill 32, left and right jambs 34 and 36 and a lintel 38. The window itself may be a conventional double-hung window or be of any other form. The window configuration per se forms no part of the present invention.

The insulating shade assembly 40 is mounted within the window frame 30 by means of a top U-shaped valance 42 secured to the bottom surface of the lintel 38 and left and right side U-shaped channels 44 and 46 secured to the facing surfaces of the jambs 34 and 36. While the valance and channels 42, 44 and 46 are shown mounted within the frame, it is to be understood that they may be mounted on the front faces of the lintel and jambs so as to project into the dwelling or other building in which the shade is installed. In the following description, the side of the shade assembly viewed from inside the structure will be deemed to be the front and the side facing the window sash covered by the shade will be called the rear or back of the assembly.

In FIG. 3, the valance 42 at the top of the shade assembly 40 is shown to include a rear vertical wall 50, a front vertical wall 52 and a top wall 54. The valance extends across the top of the window and houses much of the shade assembly. The shade assembly includes closely spaced upper and lower rollers 78 and 80 to which the upper ends of the panels 82A and 82B of insulating shade 82 are secured. The shade 82 is suspended beneath the rollers, and it carries a bottom assembly shown in FIG. 4 that may take a variety of different forms which cause the rear and front panels 82A and 82B of the shade to extend downwardly in essentially vertical planes. When the shade is fully lowered, the bottom assembly is intended to cause the shade to form a seal against the sill 32 so as to close the space S between the window W and the shade.

In FIG. 3 one technique for forming a seal between the valance and the shade 82 is suggested. In this embodiment, a thin, flexible strip 120 is shown secured to the lower end 122 of the front wall 52 of the valance 42. Typically the strip 120 may be made of a thinly-sliced foam which possess enough stiffness so as to bear firmly against the front panel 82B of the shade so as to seal the space S behind the shade assembly when the front wall 52 of the valance is in the normal vertical position. The strip 120 extends across substantially the full extent of the valance front wall 52 just inwardly of the inner edges of the side channels 44 and 46.

Figure 2:
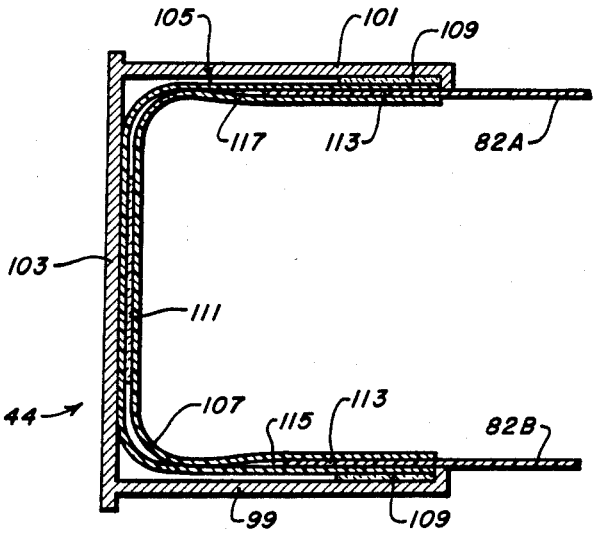

The edges of the shade panels 82A and 82B are sealed within the side channels 44 and 46 as shown in FIG. 2. The particular means of sealing the sides of the panels does not per se form part of the present invention, and it is to be appreciated that the seals may take other forms such as shown in copending application Ser. No. 06/339,334 filed Jan. 15, 1982 entitled "Insulating Window Covering", now U.S. Pat. No. 4,418,739, having a common assignee with the present application.

In FIG. 2, side channel 44 is shown, and it will be appreciated that the side channel 46 and its associated parts are the mirror images of those shown in FIG. 2. Side channel 44 includes front and rear wall parallel walls 99 and 101 joined by side wall 103 which may be screwed or otherwise secured to window jamb 34. Disposed within the channel 44 and extending substantially the full height thereof are outer and inner film sheets 105 and 107 preferably made of a UV stabilized polyester of high clarity. The outer sheet 105 which is normally of a flat configuration is sufficiently flexible so that it may be curved into a U-shaped configuration to fit within the channel 44. Adhesive strips 109 retain the sheet in place.

The inner sheet 107 is substantially the same shape as the outer sheet 105 and is attached to sheet 105 by an adhesive strip 111. The sides of the inner sheet are biased against the sides of the outer sheet 105 to form tight slots 115 and 117 to receive the vertical side edges 113 of the rear and front panels 82A and 82B of the shade to form the side seals when the shade is drawn down to its closed position. The manner in which the side edges 113 of the shade panels fit into the slots is described fully in application Ser. No. 06/406,064, supra and does not form part of the present invention.

In FIG. 4, a detail of the bottom of the shade assembly is shown. In that figure it will be noted that the rear and front shade panels 82A and 82B are secured to the outer faces of the legs 150 of inverted, horizontal U-shaped channel 152, and the lower edges of the legs 150 and the panels 82A and 82B are finished by trim pieces 154 which cover the edges. When the shade is in the lowermost position, the trim pieces 154 rest upon the sill 32 of the window frame to form a seal at the bottom.

It is evident from the foregoing description that when the shade 82 is fully lowered, the shade edges are essentially sealed so that no air is permitted to circulate through the space S between the shade assembly and the window W. Consequently, the space S tends to act as a solar collector when the shade is drawn during daylight hours, and tests have demonstrated that the temperature in the space S can reach the 200° F. range. Such temperatures are potentially harmful both to the shade assembly and the window unit. Consequently, ventilating means for the space S are provided both at the top and bottom of the window. To permit ventilation of the space S at the top of the assembly, the front wall 52 of the valance 42 is pivotally mounted on the upper wall 54, as shown in FIGS. 3, 5 and 5A. The front wall 52 is formed with a socket 100 at its upper edge, which receives the bead 102 formed along the front edge 104 of upper wall 54. This connection permits the wall 52 to swing outwardly as shown in FIGS. 3 and 5A away from the front walls 99 of the two side channels 44 and 46. Consequently, hot air in the space S is allowed to escape about the top of upper roller 78 as suggested by the arrows 110.

Bimetallic strips 112 are mounted on each end of the front wall 52 of the valance 42 and bear against the front face of the side channel walls 99 to cause the front wall 52 of the valance to pivot to the open position in response to elevated temperatures in the space S as the bimetallic elements are exposed to the air temperatures in space S. The bimetallic strips 112 which may typically be made of lengths of iron and nickel are adhered at one end to the front wall 52 of the valance, and their free ends bear against the walls 99. When the temperature of the bimetal is in the 80° F. range or less, the bimetal is flat, and the wall 52 hangs in the vertical position from the pivotal connection with the top wall 54, and the strip 120 forms a seal against the shade. However, when the temperature of the bimetal rises to the range of approximately 120° F., it bends and pushes the front wall 52 of the valance to the open position shown in FIG. 5A so that air can flow out of space S as suggested by the arrows 110.

Figure 6:
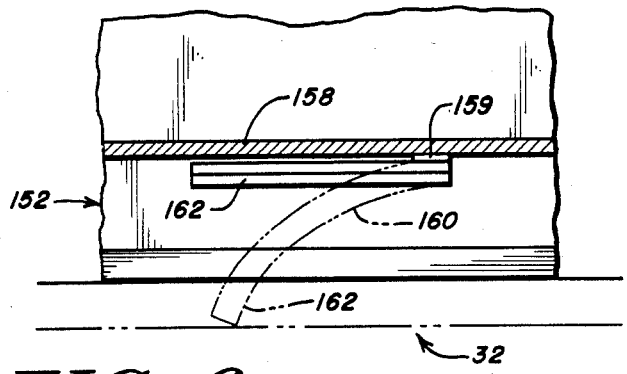
FIG. 6 is a fragmentary cross-sectional view of the bottom of the shade assembly, taken on section line 6—6 in FIG. 4, and showing the manner in which the bottom of the shade assembly is vented.

To open the space S at the bottom of the assembly, the arrangement shown in FIGS. 4 and 6 is provided. A bimetallic element 160 is mounted on the lower surface 156 of top wall 158 within the channel 152 by means of an adhesive, rivet, or some other convenient fastener as suggested at 159 in FIG. 6. When the temperature of the bimetallic element 160 in the channel 152 is in the range of 80° F., its free end 162 is disposed adjacent the upper wall 158 and does not interfere with the seal formed between the trim pieces 154 and the sill. However, when the temperature of the bimetallic element 160 is elevated to approximately 120° F., the free end 162 bears against the sill 32 and raises the channel 152 off the sill to allow air to flow from the room into the space S behind the shade panels. While one bimetallic element 160 is illustrated, it is to be understood that several may be employed on the bottom channel 152, and their number depends principally upon the width and weight of the shade. The bimetal 160 is intended to respond to the temperature in the space S, and it will be appreciated that the temperature within the channel 152 will closely approximate it. If necessary, air passages may be provided in the rear leg 150 of the channel and the fabric covering it to ensure that the bimetal 160 is exposed to the elevated temperatures.

When the bimetallic elements 112 and 160 deform in response to the elevated temperature in the space S, the front wall 52 of the valance 42 will open and the bottom of the shade assembly will lift off the sill so as to permit the free exchange of air between the space S and the room. Thus, a very simple venting system is provided for the insulating shade assembly to prevent the buildup of extremely high temperatures in the space S which may damage both the shade assembly and the window itself. The system described is totally automatic, requires no special attention, and should give trouble-free service without causing a substantial increase in the cost of the assembly.

Figure 7:
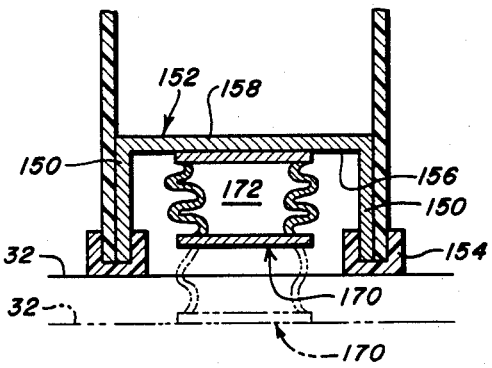
FIG. 7 is a cross-sectional view of the bottom of the shade assembly, similar to FIG. 4, but showing an alternative means for actuating the bottom vent of the assembly.

In FIG. 7, an alternative temperature responsive device is suggested for bottom channel 152 in place of the bimetallic strip 160. In that figure an expandable bellows 170 is shown mounted on the underside 156 of top wall 158 of the channel, and the bellows is filled with freon 172 or some other temperature sensitive fluid which expands markedly as its temperature increases. When the temperature in the space S and its immediate environs is in the range of 80° F., the bellows 170 is contracted to a length which is less than the height of the vertical legs 150, so as not to interfere with the contact seal between the trim pieces 154 and the sill 32. However, when the temperature of the expansible fluid is elevated to the 120° F. range, the length of the bellows exceeds the height of the legs 150, and the channel 152 and the trim pieces 154 are lifted off the surface of the sill 32 so as to form a vent opening between the bottom of the shade assembly and the sill to allow air to flow through the space S. Thus, the freon-filled bellows 170 acts as a spring to open and close the space between the channel 152 and the sill in response to changes in temperature.

While in the foregoing description the embodiments described are controlled by temperature sensitive devices to open the space S to the room and permit the flow of air from the room through it, it should be appreciated that natural convection flow using pressure differentials may be utilized to open the space S to the room. As the temperature in space S increases, the air pressure in that space also increases, and that pressure may significantly exceed the ambient pressure in the room as the temperature in space S reaches the 150°-200° F. range. By providing flapper vents at the top and bottom of the shade assembly, which open in response to elevated pressure in the space S, a convection loop may be established which causes air from the room to flow into the space from the bottom of the assembly and out the space S from the top and into the room. In this embodiment, the valance may be essentially identical to the valance 42 in the embodiment described above. However, the bimetallic elements 112 may be omitted, and rather the valance front wall 52 must be balanced with sufficient care to enable it to pivot into the room in response merely to increases in pressure behind it in space S. That is, the valance should be permitted to pivot to the position shown in FIGS. 3 and 5A in response to increased pressure in the space S.

Figure 8:
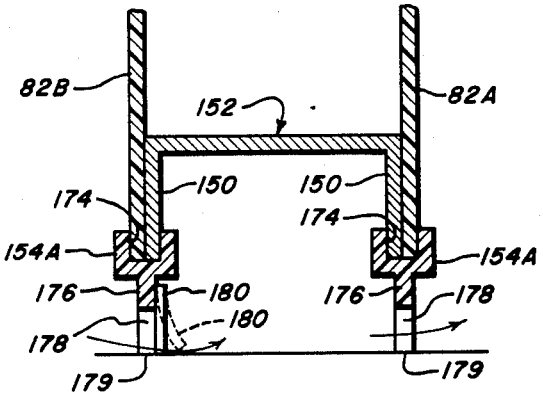
FIG. 8 is a fragmentary cross-sectional view of the bottom of another embodiment of shade assembly incorporating another venting arrangement.
Figure 9:
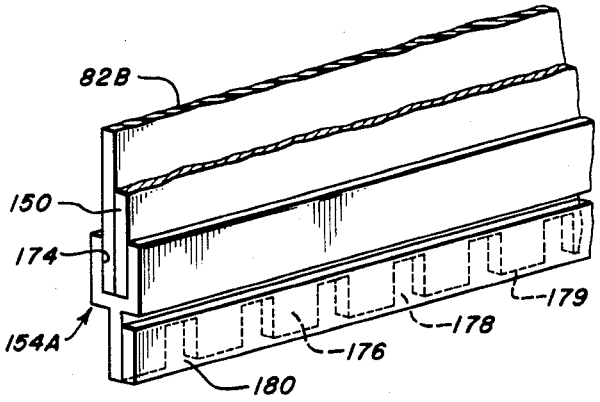
FIG. 9 is a fragmentary perspective view of a portion of the bottom shown in FIG. 8.

The vent is formed at the bottom by modifying at the construction at the bottom channel 152. In FIGS. 8 and 9 each of the trim pieces 154A is shown to be Y-shaped in cross section having an upper open channel 174 which receives the lower edge of one leg 150 of channel 152 and the bottom edge of one shade panel 82A or 82B. The trim pieces 154A include, in addition, a stem 176 having a series of notches 178 along the bottom edge 179, as shown in FIG. 9. The same arrangement is employed on each of the two legs 150 of the channel 152, that is, each of the trim pieces is provided with notches 178 in stem 176. The trim piece 154A secured to the front wall 150 and front panel 82B also carries a cover 180 in the form of a narrow fabric strip which is adhered to the stem 176 on the inside above the openings 178, and hangs over those openings. No cover is used on the back trim piece 154 nearer the window. Consequently, the space beneath the channel 152 is always open to the space S.

When the temperature in the space S rises causing the air pressure in that space also to rise, the vent at the top formed by the balanced front wall 52 of valance 42 opens by virtue of the wall 52 pivoting outwardly a sufficient distance to unseat the sealing strip 120 from the shade, and the vent at the bottom opens because the flow of air in the convection loop causes the cover 180 to swing inwardly as shown in FIG. 8 in broken lines, and expose the notches 178. Consequently, the space S may be vented with the room air to prevent harmful effects upon the shade assembly and window.

It will be appreciated that with the relatively simple arrangements shown in the drawings, the space S may be vented without adversely affecting the insulating characteristics of the shade assembly. Under normal conditions the assemblies provide good insulation so as to prevent loss of heat through the window, but during daylight no excessive buildup of temperatures will occur behind the shade which could cause damage. It will also be appreciated that while separate systems responsive to temperature and pressure have been shown and described, these systems may be combined so that, for example, the valance vent may respond to temperature by means of a heat responsive element while the bottom vent may respond to pressure differences in the space and room and/or to the flow of air created by the convection loop.

Because numerous modifications of the invention may occur to those skilled in the art after reading the foregoing, I do not intend to limit the breadth of this invention to the specific embodiments illustrated and described. Rather, its breadth is to be determined by the appended claims and their equivalents.

What is claimed is:

1. A venting system for insulating window shades comprising:

an inverted U-shaped valance adapted to be secured to the top of a window frame, said valance having top, rear and front walls, a shade roller adapted to be mounted on the window frame within or adjacent to the valance, an insulating shade on the roller adapted to be drawn from the roller over and spaced from the inside of the window to insulate it, said valance front wall being normally in a first position in sealing engagement with said insulating shade, sealing tracks adapted to be mounted on the sides of the frame and engage side edges of the shade to seal the space between the window and shade, means responsive to the temperature in the space between the shade and a window for moving said valance front wall from said first to a second position spaced from said insulating shade when the temperature in the space between the shade and window exceeds a predetermined value, and a vent disposed between said rear valance wall and said insulating shade to allow air to flow to and from the space between the shade and window and said valance front wall to vent the space between the shade and window when the valance front wall is in said second position.

2. A venting system for insulating shades as defined in claim 1 further characterized by:

additional venting means provided at the bottom of the shade for enabling air to flow into the space when air flows out the space by the valance front wall.

3. A venting system for insulating shades as defined in claim 2 further characterized by:

said temperature responsive means being a bimetallic element engaging the front wall.

4. A venting system for insulating shades as defined in claim 3 further characterized by:

said valance front wall being pivotally connected to the valance top wall enabling the front wall to move between said first position and said second position.

5. A venting system for insulating shades as defined in claim 1 further comprising a sealing strip secured on the inner edge of said valance front wall for sealing the space between said valance front wall and said insulating shade in said first position.

6. A venting system for insulating shades for use with a window in a window frame, said system comprising:

a valance adapted to be secured to the top of the window frame, said valance having top, front and rear walls;

at least one shade roller adapted to be mounted on the window frame within the valance;

an insulating shade disposed on said shade roller adapted to be drawn from the roller over and spaced from the inside of the window for insulation;

sealing tracks adapted to be mounted on the sides of the window frame and engage side edges of the shade to seal the space between the window and the shade;

means for sealing the space between said valance front wall and said insulating shade, said valance rear wall being spaced from said insulating shade to allow flow of air to and from the space between the insulating shade and the window; and hinges for securing said valance front wall to said valance top wall to permit said valance front wall to pivot from a first position in sealing contact with said insulating shade to a second position spaced from said insulating shade to allow air to pass to and from the space between the insulating shade and the window when the temperature in the space between the insulating shade and the window exceeds a prescribed value creating an air pressure sufficient to cause pivoting of said valance front wall into said second position.

7. A venting system for insulating shades as defined in claim 6 further comprising an air pressure sensitive valve disposed at the bottom of said insulating shade, said valve opening in response to pivoting of said valance front wall into said second position to permit air to flow between the room and the space between the insulating shade and the window.

8. A venting system for insulating shades comprising:

an insulating shade system adapted to be mounted on a window frame on the inside of the window and having a shade which forms a sealed space between the window and the shade on the inside of the window when the shade is drawn, said shade system having a bottom member for the shade adapted to form a seal with the window sill when the shade is drawn, said bottom member including a vertical leg; and venting means forming a part of the shade system and being responsive to the temperature of the air in the sealed space for permitting the air to flow from outside the space and through the space when the temperature in the space exceeds a prescribed value, said venting means comprising:

a valve at the top of the shade system for opening and closing said space to the room insulated by the shade; and a valve at the bottom of the shade system for opening and closing said space to the room insulated by the shade, said bottom valve including an air passage in said vertical leg and a cover movably mounted on the vertical leg to close and open the air passage.

9. A venting system for insulating shades comprising:

an insulating shade system adapted to be mounted on a window frame on the inside of the window and having a shade which forms a sealed space between the window and the shade on the inside of the window when the shade is drawn, said shade system having a bottom member for the shade adapted to form a seal with the window sill when the shade is drawn; and venting means forming part of the shade system and being responsive to the temperature of the air in the sealed space for permitting the air to flow from outside the space through the space when the temperature in the space exceeds a prescribed value, said venting means comprising:

a valve at the top of the shade system for opening and closing said space to the room insulated by the shade; and a bottom valve disposed on the bottom member for opening and closing said space to the room insulated by the shade, said bottom valve including temperature responsive means mounted on the bottom member for lifting the bottom member off the sill to open the seal.

* * * * *